United States Patent [19]

Focke

[11] Patent Number: 5,031,381

[45] **Date of Patent: * Jul. 16, 1991**

[54] PACKAGING MACHINE, ESPECIALLY FOR CIGARETTES

[75] Inventor: Heinz Focke, Verden, Fed. Rep. of Germany

[73] Assignee: Focke & Co., (GmbH & Co.), Verden, Fed. Rep. of Germany

[ * ] Notice: The portion of the term of this patent subsequent to Jan. 30, 2007 has been disclaimed.

[21] Appl. No.: 337,693

[22] Filed: Apr. 13, 1989

[30] Foreign Application Priority Data

Apr. 15, 1988 [DE] Fed. Rep. of Germany ..... 3812514

[51] Int. Cl.[5] ..... B65H 9/12; B65B 41/12

[52] U.S. Cl. ..... 53/389.1; 242/58.6

[58] Field of Search ..... 53/389, 203, 148, 203, 53/558; 242/58, 58.2, 58.6

[56] References Cited

U.S. PATENT DOCUMENTS

| | | | |
|---|---|---|---|
| 4,366,932 | 1/1983 | Focke | 242/58.6 |
| 4,441,662 | 4/1984 | Seragnoli | 242/58.6 X |
| 4,589,811 | 5/1986 | Riccardo et al. | 242/58.6 X |
| 4,614,075 | 9/1986 | Focke et al. | 53/168 |
| 4,840,321 | 6/1989 | Focke et al. | 248/58.6 |
| 4,892,263 | 1/1990 | Beisswanger | 242/58.6 X |
| 4,896,842 | 1/1990 | Focke | 242/58.6 |
| 4,907,689 | 3/1990 | Focke | 198/487.1 |

FOREIGN PATENT DOCUMENTS

| | | |
|---|---|---|
| 0260453 | 3/1988 | European Pat. Off. . |
| 1505340 | 12/1967 | France . |

*Primary Examiner*—Horace M. Culver

*Attorney, Agent, or Firm*—Sughrue, Mion, Zinn, Macpeak & Seas

[57] ABSTRACT

The supply of web-like packaging material to high-performance packaging machines has hitherto involved a high outlay in terms of labor. The packaging material in the form of reels (13) has to be fed to the packaging machine conveyed up to a working journal (11, 12). Manual involvement has hitherto been needed for this. However, according to the Disclosure, the fully mechanical transfer of reels (13), from a reel stock (15) to one of two working journals (11, 12) a transport journal (20) mounted on a transport arm (21) is used. The transfer of the reels (13) onto a working journal (11, 12) is carried out by the axis-parallel displacement of a catch, in particular of a push sleeve (44) actuated by the transport arm. Furthermore, a reel core (1) of a reel (13*a*) which has run empty is stripped from the working journal (11, 12) by the transport arm (21) and tube strippers 51, 52) mounted thereon. Thus, the supply of reels (13) of packaging material to the packaging machine takes place completely automatically and without any manual involvement.

16 Claims, 6 Drawing Sheets

PACKAGING MACHINE, ESPECIALLY FOR CIGARETTES

BACKGROUND OF THE INVENTION

The invention relates to a packaging machine for the production of (cigarette) packs from web-like packaging material which is drawn off from a (working) reel on a working journal, new "full" reels being conveyed by a transport journal into axial alignment in front of the working journal and being transferred onto this as a result of axial displacement.

In packaging machines of this type, the reels of packaging material are conventionally extracted from a reel stock located on the machine and are then fed to the working journal having a reel which has run empty. The transport journal can follow different paths of movement on its way to the reel stock and from this to the working journal respectively. In a packaging machine according to the older German Patent Application P 37 21 091.2 (corresponding to U.S. Pat. No. 4,896,842, issued Jan. 30, 1990), the transport journal is arranged on a transport arm, which is moveable to and fro by pivoting between the reel stock on the one hand and one of two working journals. For an exact adjustment to the reel or to the working journal, the transport journal is displaceable on the transport arm in the longitudinal direction of the latter.

In known apparatuses or packaging machines, as in the subject of the aforesaid older Patent Application, manual involvement is necessary in order to make it possible to transfer the (full) reels onto the particular working journal.

SUMMARY OF THE INVENTION

The objective on which the invention is based is, therefore, to mechanize further the change of the reels of packaging material within a packaging machine and make it completely free of manual involvement.

To achieve this objective, the packaging machine according to the invention is characterized in that the reel can be transferred from the transport journal onto the working journal by mechanical conveying means.

As a result of the invention, the transfer of the reels from the transport journal onto the equiaxially directed working journal becomes free of manual involvement.

According to the invention, the mechanical conveying means for transferring the reel from the transport journal to the working journal is an axially moveable stripper, especially a push sleeve which, as a result of axis-parallel movement, pushes the reel from the transport journal onto the working journal directly adjacent to the free end of the transport journal.

According to the invention, the conveying movement of the slide or of the push sleeve is effected by the transport arm. This is therefore moveable in the axis-parallel direction in the transfer position for a reel.

In a preferred embodiment of the invention, in the transfer position the transport journal is moved in front of the free end of the ready-to-receive working journal and is supported on this. The transport arm is then moved in the axial direction, thereby taking up the slide or the push sleeve which is moved relative to the transport journal, thereby taking up the reel, until the latter rests on the working journal.

According to a further proposal of the invention, a reel core of run-empty reel is also removed from the respective working journal automatically and mechanically, before the next (full) reel is pushed onto the working journal. For this purpose, according to the invention there is provided a conveying member which grasps the reel core and which takes up the reel core as a result of an appropriate conveying movement in the longitudinal direction of the working journal. Preferably, this conveying member is designed as a stripper which grasps the reel core on an inner end face and which strips the reel core from the working journal.

According to the invention, the abovementioned stripper is connected to the transport arm of the transport journal and is actuated in a suitable way by the transport arm.

Thus it becomes possible to achieve a completely mechanized exchange of the reels within a packaging machine without any manual involvement.

Further features of the invention relate to the design of the conveying members for reels and reel tubes.

An exemplary embodiment of the invention is explained in detail below with reference to the drawings. In these:

DETAILED DESCRIPTION OF A PREFERRED EMBODIMENT

Figure 1:
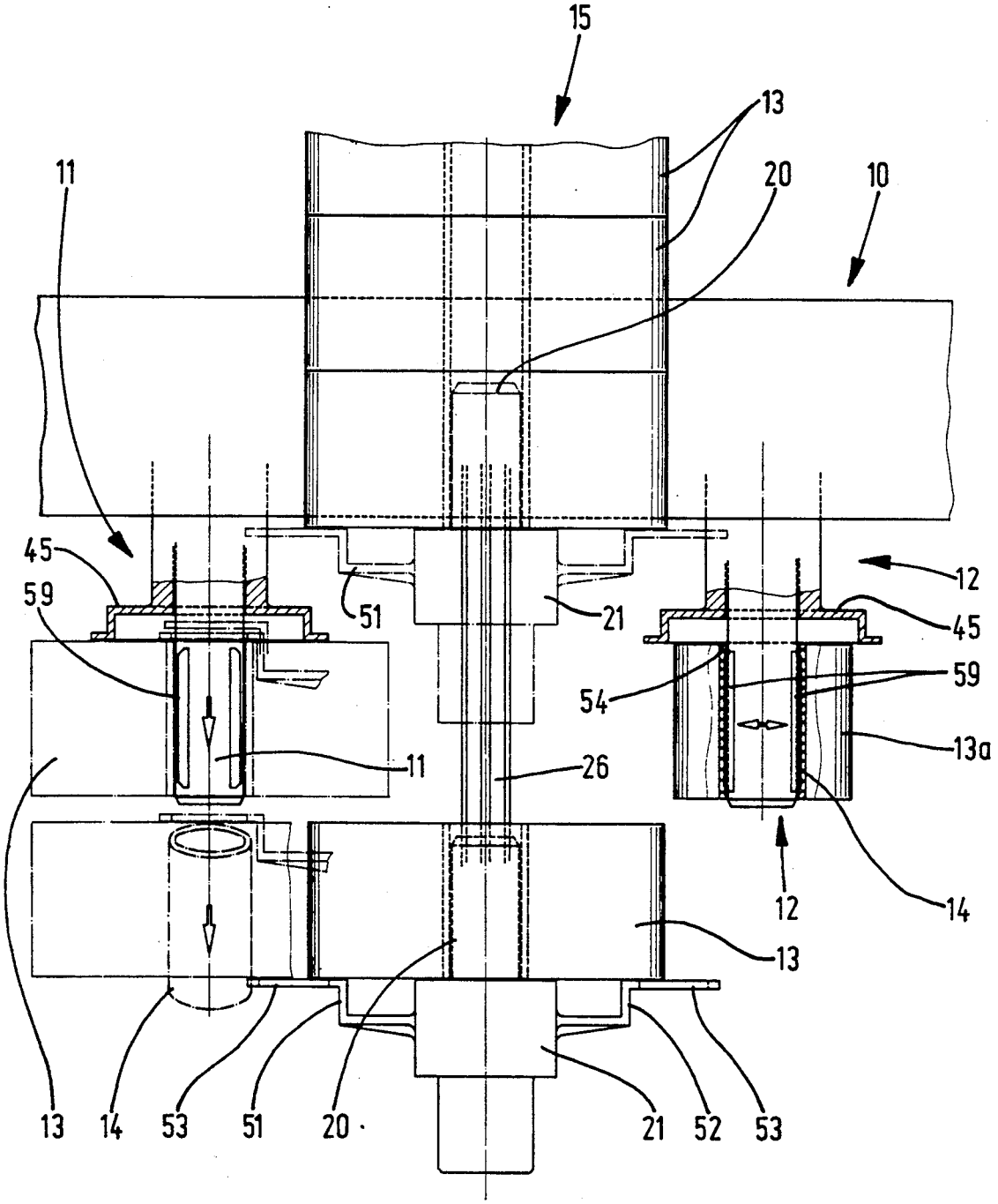
FIG. 1. shows a plan view of a reel station as part of the packaging machine.

The reel station illustrated as an exemplary embodiment in the drawings corresponds in basic design to that of the apparatus according to Patent Application P 3721 091.2. Accordingly, two working journals 11 and 12 are mounted rotatably on a machine stand 10 of a conventional packaging machine not shown in detail for the sake of simplicity. The freely projecting or overhanging working journals 11, 12 each serve for receiving a reel 13.

The reels 13 are wound rolls of web-like packaging material, for example tin foil, plastic film or the like. For the processing of the packaging material within the packaging machine, the web-like packaging material is drawn off from a running (working) reel 13*a*. When this is used up, the packaging material is drawn off from a "full" reel 13 provided on the adjacent working journal 11.

Meanwhile, the run-empty working journal 12 is prepared for receiving a new "full" reel. For this purpose, a tubular reel core 14 is first eliminated. A new reel is then pushed onto the working journal 12.

The "full" reels 13 are extracted from a reel stock 15 and fed alternately to one working journal 11, 12 or the other. In the region of the reel stock 15, a multiplicity of reels 13 is arranged in a vertical plane and in axial alignment with one another. The particular reel 13 located at the front is extracted. The following reels are conveyed correspondingly further. As in the apparatus according to Patent Application P 37 21 091.2, the reels 13 of the reel stock 15 rest on carrier shafts 16, 17 driven with a conveying effect. The particular reel 13 located at the front comes to bear on supporting rolls 18 (FIG. 2) having an inclined swivelling axis. The carrier shafts 16, 17 and supporting rolls 18 are mounted on a supporting frame 19.

The mechanized or automated transport of the reels 13 to the working journals 11, 12 is effected by a transport journal 20 which receives a particular front reel 13 in the reel stock, executes a lifting movement to free the reel, then moves it into a plane in front of the working journals 11, 12 and thereupon feeds it to one of these two.

For this purpose, the transport journal 20 is mounted on a conveyor which is designed here as a pivotable transport arm 21, specifically essentially having the features of aforesaid Patent Application P 37 21 091.2.

Figure 3:
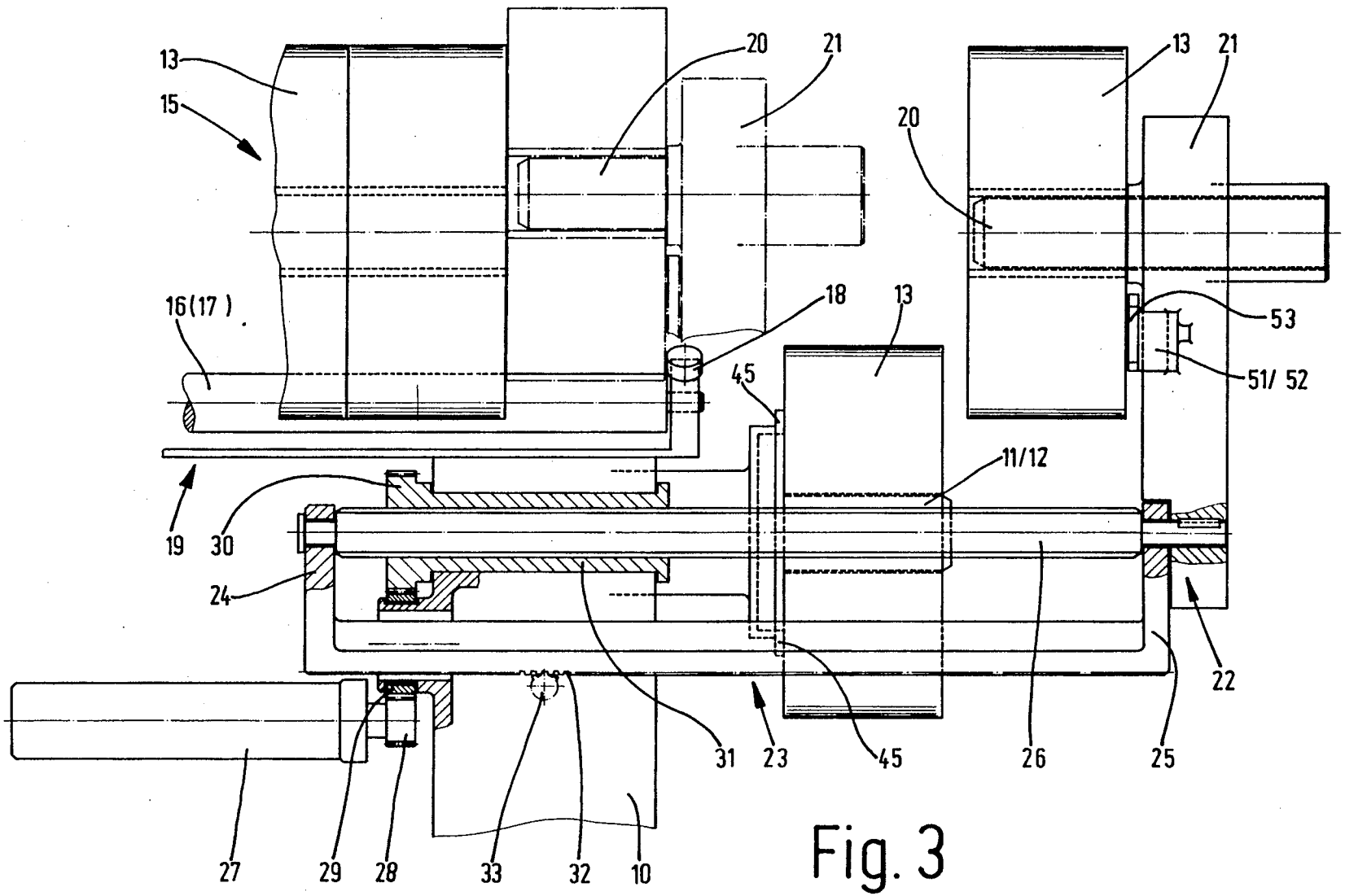
FIG. 3 shows a side view of the apparatus according to FIGS. 1 and 2, partially in longitudinal section.

The transport arm 21, in a lower end region, is mounted by means of a pivot bearing 22 on a supporting device 23 which, as seen in side view (FIG. 3), is of U-shaped design with vertical supporting walls 24, 25 at the ends in which a toothed main shaft 26 is rotatably mounted rotatably and driven via a drive motor 27 with a pinion 28, an intermediate gear wheel 29 and a gear wheel 30 which is part of a rotatably mounted guide sleeve 31. The main shaft 26 is mounted in the latter so as to be relatively non-rotatable, but axially displaceable. The to-and-fro rotary drive for the transport arm 21 is therefore transmitted via the guide sleeve 31 to the main shaft 26 connected to the transport arm 21.

The supporting device 23 is moveable to and fro as a whole in the direction transversely relative to the pivoting plane of the transport arm 21. For this purpose, a rack 32, with which a pinion 33 rotatably in one direction and the other is engaged, is formed on the under side of the supporting device 23. The pinion 33 driven by a motor not shown in detail allows a movement of the transport arm 21 in a direction axis-parallel to the working journals 11, 12. At the same time, the main shaft 26 is guided slideably in the guide sleeve 31 of fixed location.

Furthermore, as described in Patent Application P 37 21 091.2, the transport journal 20 is moveable relative to the transport arm 21, specifically in the longitudinal direction of the same. For this purpose, the transport journal 20 is mounted in a slide 34 of the transport arm 21. The slide 34 is displaceable within the transport arm 21, designed as a hollow body, in the longitudinal direction of the latter. A servomotor 35 mounted on the transport arm 21 serves for executing adjusting movements. A motor shaft 36 is designed as a spindle and is engaged with a spindle nut 37. This in turn is connected to the slide 34. Rotational movements of the motor shaft 36 thus cause adjusting movements of the slide 34 in the longitudinal direction of the transport arm 21.

Figure 4:
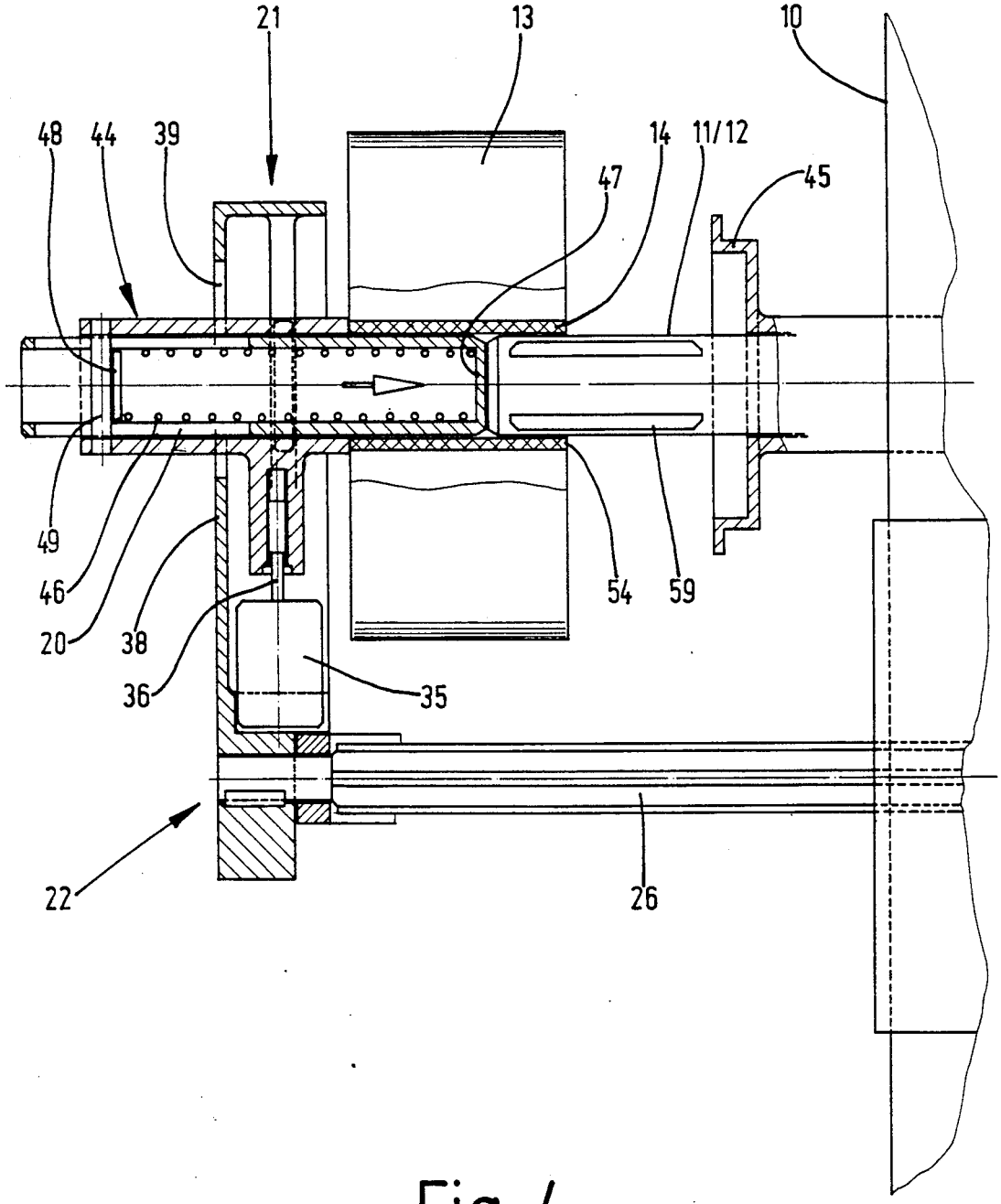
FIG. 4 shows a side view, partially in longitudinal section, of a detail of the apparatus according to FIGS. 1 to 3, particularly an illustration of a reel change.

As is evident especially from FIG. 4, the transport arm 21 is of U-shaped cross-section. A back wall 38 is equipped with a recess 39 for the passage of the transport journal 20. The slide 34 is guided in side walls 40, 41 of the transport arm 21, specifically by means of guide grooves 42 in the side walls 40, 41. Guide ribs 43 of the slide 34 penetrate positively into the guide grooves 42.

Figure 5:
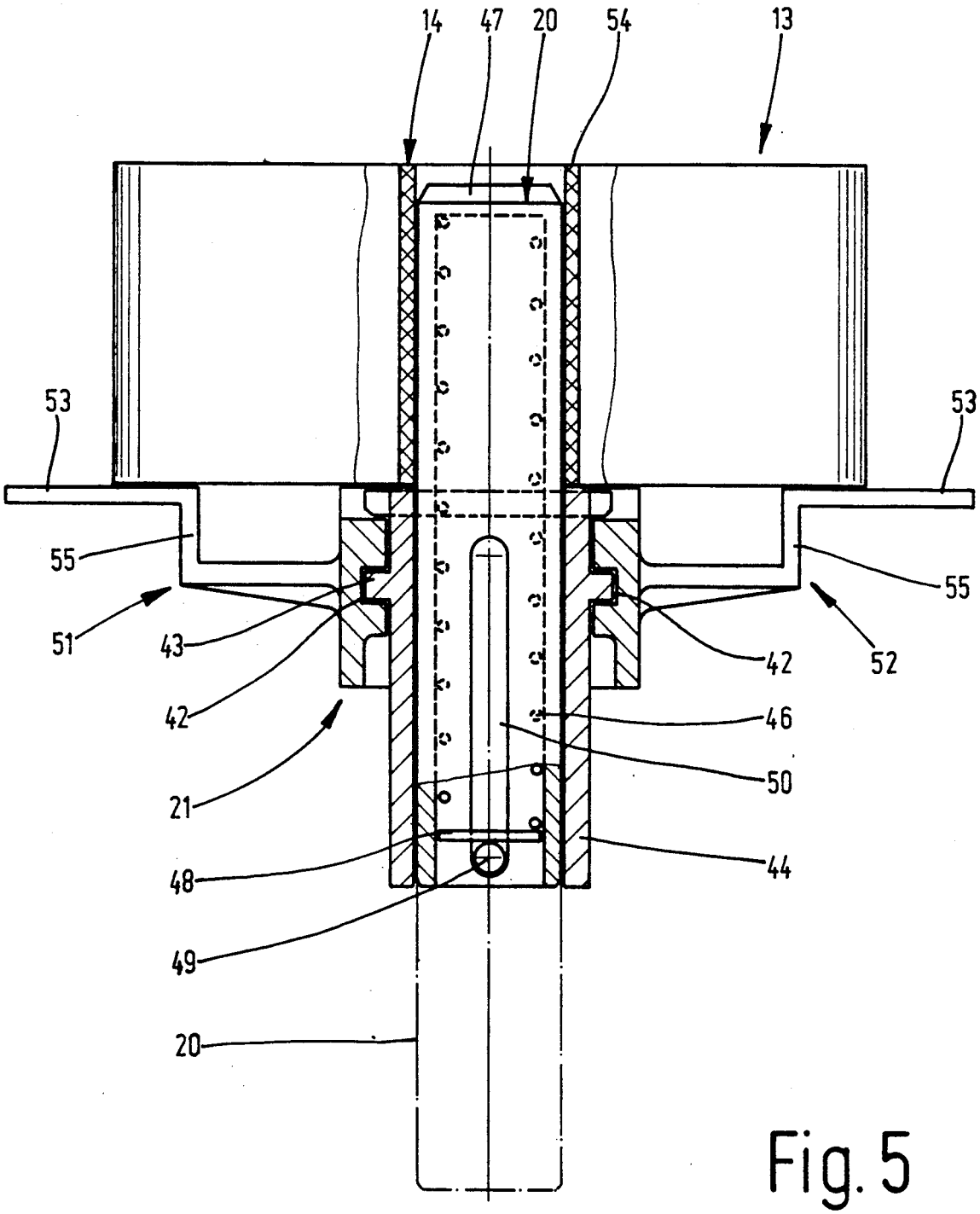
FIG. 5 shows a plan view, partially in horizontal section, of a transport journal with a reel.

The transport journal 20 projects from the slide 34 or from the transport arm 21 on one side and can thereby receive a reel 13 (FIG. 5). The transfer of this to one of the two working journals 11, 12 is carried out with the transport journal 20 positioned equiaxially in front of the respective working journal 11, 12, (FIG. 4). The transport journal 20 is mounted so as to be axially displaceable slideably on the transport arm 21, in particular in the slide 34. The latter is extended beyond the transport arm 21 on both sides and forms a push sleeve 44, in which the transport journal 20 is mounted.

For the mechanical and automatic transfer of the reel 13 to the free working journal 11, 12 the transport journal 20 is supported against the free end of the working journal 11, 12, (FIG. 4). Due to displacement of the transport arm 21 in the axial direction of the working journal 11, 12, the transport journal 20 is displaced relatively in the slide 34 or push sleeve 44. At the same time, the reel 13 is supported on the front end of the push sleeve 44. The latter, during a continued movement of the transport arm 21, presses the reel 13 onto the working journal 11, 12. The transport journal 20 comes out of the reel 13 to the same extent.

In the end position, the reel 13 is located on the respective working journal 11, 12, at the same time bearing on a stationary supporting disc 45 of the working journal 11, 12. The supporting disc 45 ensures an exact positioning of the particular working reel 13*a* on the working journal 11, 12, even during the drawing off of the web of material.

The transport journal 20 is spring-loaded, particularly in the direction of the initial position (FIG. 5) in relation to the transport arm 21. In the exemplary embodiment illustrated, the transport journal 20 is designed as a hollow body. Arranged within this is a restoring spring 46. This is supported on an end wall 47 of the transport journal 20 on the one hand and on a support plate 48 on the other hand. The support plate 48 comes to bear on the crosspin 49, the ends of which are connected to the push sleeve 44 and which extends transversely through the hollow transport journal 20. For this purpose, the latter is equipped, on two sides located opposite one another, with a guide slot 50 for the passage of the crosspin 49. When, after a reel 13 has been transferred to a working journal 11, 12, the transport arm 21 is moved back into the initial position in the opposite direction as a result of corresponding drive movement of the pinion 33, the transport journal 20 also returns automatically into the initial position in relation to the transport arm 21 (FIG. 5).

As is generally customary, the reels 13 are equipped with a reel core 14, onto which the web material is wound. The tubular reel core 14 often consists of cardboard, but can also consist of other materials. The transport journal 20, like the working journals 11 and 12, likewise enters the cylindrical reel core 14. After a reel 13 has run empty, the reel core 14 remains on the working journal 11, 12. The apparatus illustrated is designed so that the reel core 14 is automatically removed from the run-empty working journal 11, 12.

For this purpose, there is provided a stripper which, by means of an appropriate relative movement, strips the empty reel core 14 from the working journal 11, 12 in the axial direction of the latter. As shown, a separate tube stripper 51, 52 is assigned to each working journal 11, 12. Each of these tube strippers 51, 52 has a circularly arcuate or semi-circular catch 53. For stripping a reel core 14 from a working journal 11, 12, the tube stripper 51, 52 is moved into a position in which the catch 53 comes to bear on an end face 54 on the inside or remote from the free end of the working journal 11, 12 (on the left in FIG. 1). As a result of a displacement of the tube stripper 51, 52 in an axial direction of the working journal 11, 12, the reel core 14 is pushed off. For this purpose, the catch 53 has a dimension corresponding to the diameter of the reel core 14.

In the apparatus illustrated, the tube strippers 51, 52 are mounted on the transport arm 21 and are thus actuated by this. A catch 53 is mounted on a supporting arm 55 on each of the two opposite sides. The two supporting arms 55 are fastened to opposite sides of the transport arm 21, so that they can be applied to one working journal 11, 12 or the other by means of a pivoting movement and axis-parallel movement of the transport arm 21. For stripping a reel core 14 from a working journal 11, 12, the transport arm 21 is moved in an axis-parallel direction in the way described.

The supporting arms 55 are bent (FIG. 5). The catches 53 arranged at the ends are therefore located in a plane in which they serve at the same time as a bearing for a reel 13 arranged on the transport journal 20.

Figure 6:
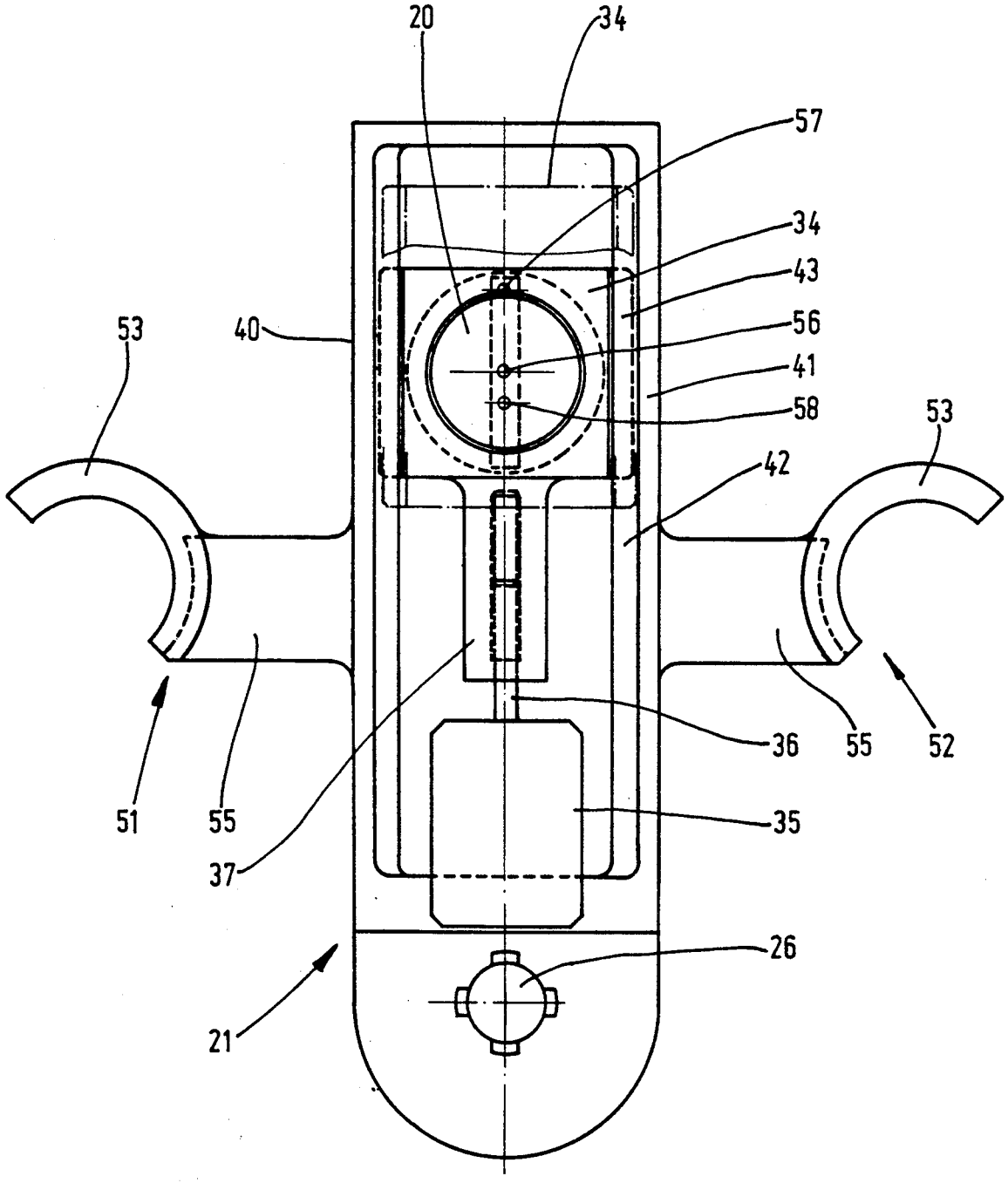
FIG. 6 shows a front view of a transport arm of a detail of the apparatus.

With the apparatus described, an automatic fully mechanized feed of reels 13 to the working journals 11, 12 takes place as follows:

In the vertical mid-position of the transport arm 21, the slide 34 together with the transport journal 20 is moved into an upper position 56 (FIG. 6) where the transport journal 20 is aligned with a particular front reel 13 of the reel stock 15. As a result of an axially directed displacement, the transport journal 20 can receive the front reel 13.

So that this front reel is freed from the reel stock 15, the slide 34 together with the transport journal 20 is moved into an even higher upper end position 57. The transport arm 21 can now be moved back in the axis-parallel direction into a plane in which the transport journal 20 extends in front of the ends of the working journals 11, 12. The slide 34 is now moved back into a lower inner position 58 where the transport journal 20 is aligned exactly with the working journals 11, 12 when the transport arm 21 is moved in front of one working journal 11, 12 or the other as a result of a pivoting movement.

In the position of axial alignment, the transfer of the reel 13 to one working journal 11, 12 or the other takes place in the way described, specifically by means of a new axially directed displacement of the transport arm 21. At the same time, the reel 13 is taken up by the transport arm 21 or by the push sleeve 44.

After the "full" reel 13 has been transferred to a working journal 11, 12, the web of material of this reel is joined to the constantly running-off web of material of the other working journal, as soon as the current reel 13*a* has run empty.

Figure 2:
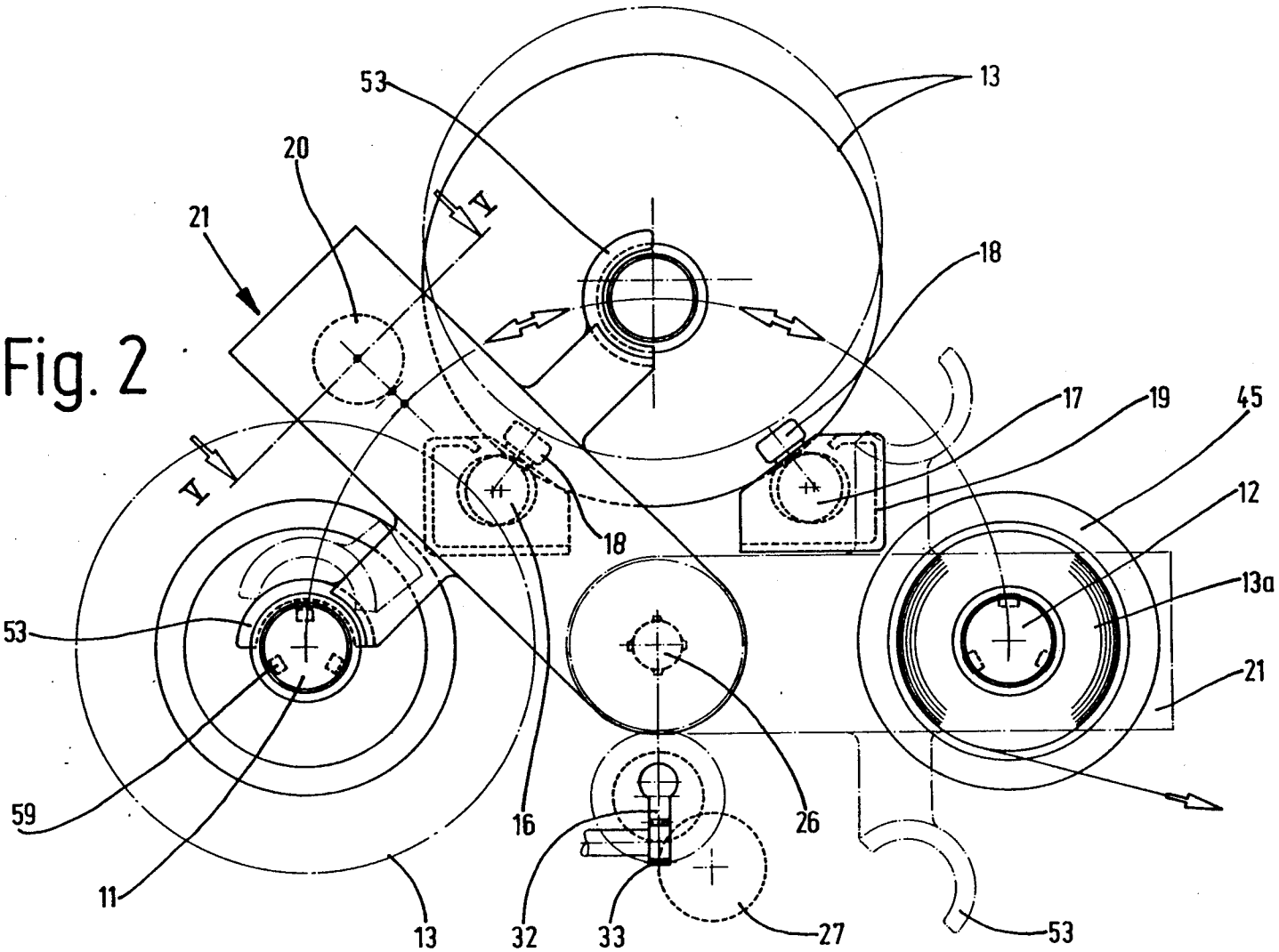
FIG. 2 shows a front view of the apparatus according to FIG. 1.

Before the working journal 11, 12 which has run empty is reloaded, the reel core 14 is eliminated. For this purpose, an axis-parallel displacement of the transport arm 21 takes place, until the tube stripper 51, 52 or the catch 53 assigned to the respective working journal 11, 12 is in the plane behind the end wall 54 of the reel core 14. The catch 53 is brought into the stripping position by means of a pivoting movement of the transport arm 51 (FIG. 1 or FIG. 2). As a result of a new axis-parallel movement of the transport arm 21, the reel core 14 is pushed off from the respective working journal 11, 12.

The working journals 11, 12 can be equipped in a known way with radially moveable clamping jaws 59. These are moved into a clamping position directed radially outwards, when a reel 13 is located on the respective working journal 11, 12. For pushing a reel 13 onto the working journal 11, 12 or for stripping the empty reel core 14 from the working journal 11, 12, the clamping jaws 59 are moved radially inwards, so that a tension-free movement of the reel 13 or of the reel core 14 can take place.

I claim:

1. In a packaging machine for producing cigarette packs from web-like packaging material which is drawn off from a working reel having an axially extending working journal, the improvement for automatically transferring a new full reel onto the working journal, comprising:

a transport journal for supporting the new reel; and movable mechanical conveying means (21) both for moving said support journal carrying the new reel, into axial alignment with, and in front of, the working journal, and also for pushing the new reel (13) in the axial direction from the transport journal (20) and onto the working journal (11, 12).

2. Packaging machine according to claim 1, wherein said conveying means comprises slide means (44), movable in the axial direction relative to the transport journal, for transferring the new reel onto the working journal (11, 12).

3. Packaging machine according to claim 2, further comprising restoring spring means (46) for loading the slide means in the direction of an initial position.

4. Packaging machine according to claim 3, wherein said conveying means comprises pivotable transport arm means (21) on which the transport journal (20) is mounted, and further comprising means for actuating the slide means (44) in response to an appropriate movement of the transport arm means (21) in the axial direction of the transport journal (20).

5. Packaging machine according to claim 4, wherein the transport arm means (21) moves the transport journal (20) into an equiaxial position in front of the working journal (11, 12) and then displaces the slide means (44) relative to the transport journal (20) and to the working journal (11, 12), the reel (13) thereby being taken up.

6. Packaging machine according to claim 4, wherein the transport journal (20) is mounted axially displaceably on the transport arm means (21) and is movable into the initial position by said restoring spring means (46).

7. Packaging machine according to claim 2, wherein the slide means is a sleeve-shaped stripper (44) which is arranged concentrically relative to the transport journal, and further comprising means for moving said stripper (44) up against a radially inner region of the new reel (14) when there is equiaxial alignment of the transport journal (20) and the working journal (11, 12).

8. Packaging machine according to claim 1 or 2, wherein, for transferring the reel (13) onto the working journal (11, 12), said conveying means (21) supports the transport journal (20) against a free end of the working journal (11, 12), thereby taking up the new reel (13).

9. Packaging machine according to claim 1, wherein there are two working journals (11, 12) each having support plates (48) for supporting a full reel (13, 13*a*).

10. Packaging machine according to claim 1, wherein said conveying means (21) also pushes a reel core (14) of a run-empty reel (13*a*) off the working journal (11, 12).

11. Packaging machine according to claim 10, wherein said conveying means comprises tube stripper means (51, 52), movable in the axial direction of the working journal (11, 12), for taking up the reel core (14).

12. Packaging machine according to claim 11, wherein the tube stripper means (51, 52) has a semi-circular catch means (53), coordinated with the diameter of the reel core (14), for grasping the reel core (14).

13. Packaging machine according to claim 12, wherein said catch means comprises catches (53) which are located in a bearing plane for a reel (13) supported on the transport journal (20).

14. Packaging machine according to claim 11, wherein the tube stripper means (51, 52) is mounted on the transport arm means (21) is movable thereby.

15. Packaging machine according to claim 14, wherein there are two working journals (11, 12), and wherein the transport arm (21) means has, on each of two sides located opposite one another, a tube stripper means (51, 52) assigned to a different one of said two working journals (11, 12).

16. Packaging machine according to claim 11, further comprising means for moving the tube stripper means (51, 52) into a position against an inner end face (54) of the reel core (14) and then in the axial direction of the working journal (11, 12) to a free end of the latter, the reel core (14) thereby being taken up.

* * * * *